United States Patent [19]

Hirata et al.

[11] Patent Number: 4,865,115

[45] Date of Patent: Sep. 12, 1989

[54] POURING DEVICE FOR DUAL-ROLL TYPE CONTINUOUS CASTING MACHINES

[75] Inventors: Atsushi Hirata, Hiratsuka; Hisahiko Fukase, Tokyo; Kunio Matsui; Akihiro Nomura, both of Yokohama, all of Japan

[73] Assignee: Ishikawajima-Harima Jukogyo Kabushiki Kaisha, Japan

[21] Appl. No.: 279,997

[22] Filed: Dec. 5, 1988

[30] Foreign Application Priority Data

Dec. 21, 1987 [JP] Japan ..... 62-193746[U]
Mar. 3, 1988 [JP] Japan ..... 63-50016[U]

[51] Int. Cl.[4] ..... B22D 11/06

[52] U.S. Cl. ..... 164/428; 164/437; 164/438; 164/439; 164/488; 164/489; 222/591; 222/592

[58] Field of Search ..... 164/428, 437, 438, 439, 164/481, 488, 489; 222/591, 592, 594, 597, 599, 606

[56] References Cited

U.S. PATENT DOCUMENTS

| | | | |
|---|---|---|---|
| 2,128,941 | 9/1938 | Hudson . | |
| 4,303,181 | 12/1981 | Lewis et al. | 222/591 |
| 4,641,767 | 2/1987 | Smith | 164/428 |
| 4,694,887 | 9/1987 | Matsui et al. | 164/428 |
| 4,784,208 | 11/1988 | Fukase | 164/428 |

FOREIGN PATENT DOCUMENTS

| | | | |
|---|---|---|---|
| 77962 | 6/1980 | Japan . | |
| 193739 | 11/1984 | Japan | 164/439 |
| 21171 | 2/1985 | Japan | 164/428 |
| 27449 | 2/1985 | Japan . | |
| 216956 | 10/1985 | Japan . | |
| 165257 | 7/1986 | Japan . | |
| 195747 | 8/1986 | Japan . | |
| 9754 | 1/1987 | Japan | 164/428 |
| 21445 | 1/1987 | Japan | 164/428 |

*Primary Examiner*—Kenneth J. Ramsey
*Assistant Examiner*—Edward A. Brown

[57] ABSTRACT

Melt flows down through downspouts into a basin defined by a pair of cooling rolls and side dams. Melt is decreased in flow rate to be supplied uniformly through a slit nozzle in a widthwise direction of the cooling rolls so that a solidified shell formed over the cooling rolls can be prevented from being melted again.

3 Claims, 4 Drawing Sheets

POURING DEVICE FOR DUAL-ROLL TYPE CONTINUOUS CASTING MACHINES

BACKGROUND OF THE INVENTION

The present invention relates to a pouring device for a dual-roll type continuous casting machine for direct formation of melt into a strip of sheet metal.

Well known in the art are continuous casting machines in which melt such as molten steel is poured into a water-cooled mold to form a casting which is pressed by a plurality of rollers and drawn into slabs, billets or the like. The slabs or billets thus cast are cut into a predetermined length and then transferred through a heating furnace to a rolling mill. As an improvement in the structure of such continuous casting machines for producing slabs, billets or the like, a so-called dual-roll type continuous casting machine capable of forming melt directly into a strip of sheet metal has been devised and demonstrated.

As shown in FIGS. 1 and 2, a dual-roll type continuous casting machine comprises a pair of cooling rolls 1 disposed horizontally and substantially in parallel with each other in a spaced-apart relationship. Side dams 2 are disposed at widthwise ends of the rolls 1. A tundish 4 for pouring melt 3 is disposed above the cooling rolls 1 and a core 5 extends downwardly from the bottom of the tundish 4. A pouring passage 6 for pouring melt 3 is defined through the tundish 4 and the core 5. The pair of cooling rolls 1 and the side dams 2 at the widthwise ends thereof define a basin 7 into which the bottom of the core 5 is immersed. The pouring passage 6 is positioned to open substantially toward a middle point between the axes of the rolls 1. Melt 3 is charged from the tundish 4 through the pouring passage 6 to form a basin 7 where melt 3 is cooled by the pair of cooling rolls 1 to form a solidified shell 8, whereby a casting 9 in the form of sheet metal is continuously cast by rotation of the cooling rolls 1 in the directions indicated by the arrows.

When melt 3 is poured from the tundish 4 through the core 5 into the basin 7 in the dual-roll type continuous casting machine described above with reference to FIG. 1, the pressure or flow rate of melt 3 is so high that contact of melt 3 with the solidified shell 8 which is being formed by the cooling rolls 1 tends to result in re-melting of the solidified shell 8. Such re-melting of the solidified shell 8 will cause variations in thickness, cracking or bulging of the casting 9. It follows therefore that in order to prevent the re-melting of the solidified shell 8, the pressure or flow rate of melt flowing down out of the pouring hole 6 of the core 5 must be decreased and a countermeasure for avoiding direct contact of melt 3 being poured with the solidified shell 8 must be devised.

In view of the above, a primary object of the present invention is to provide a pouring device for a dual-roll type continuous casting machine in which a manifold for temporarily receiving melt from the tundish is disposed within the core so that the pressure or flow rate of melt flowing down out of the core is decreased and direct contact of melt with the solidified shell is avoided.

The above and other objects, features and advantages of the present invention will become more apparent from the following description of preferred embodiments thereof taken in conjunction with the accompanying drawings.

DETAILED DESCRIPTION OF THE PREFERRED EMBODIMENTS

The same references numerals are used to designate similar parts throughout FIGS. 1, 2, 3 and 4.

Figure 1:
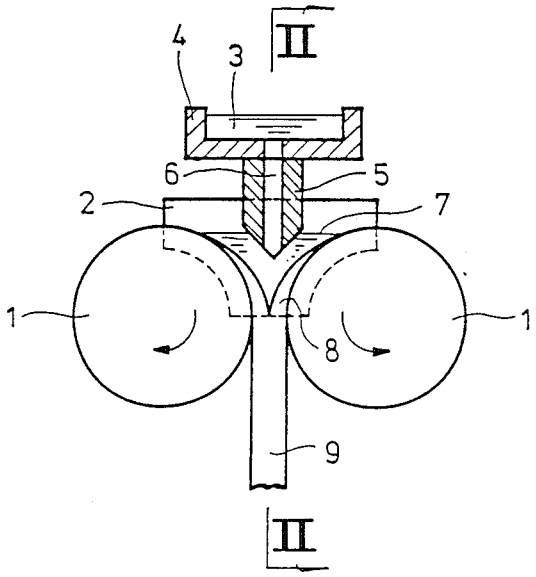
Fig. 1 PRIOR ART
FIG. 1 is a front sectional view of a conventional device.
Figure 2:
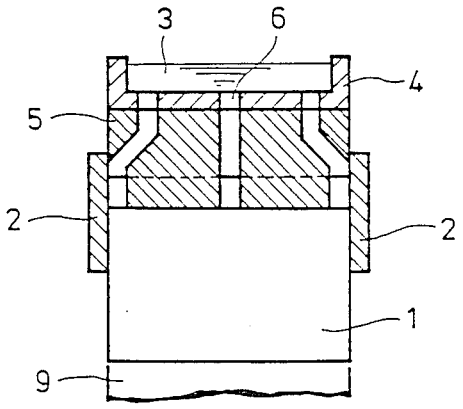
Fig. 2 PRIOR ART
FIG. 2 is a sectional view taken along the line II—II of FIG. 1.
Figure 3:
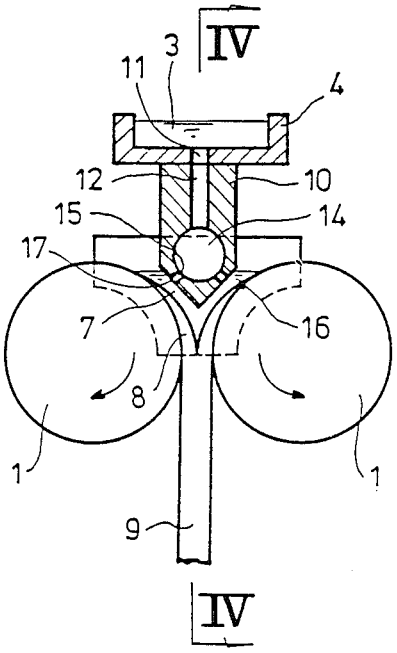
FIG. 3 is a front sectional view of a first preferred embodiment of the present invention.
Figure 4:
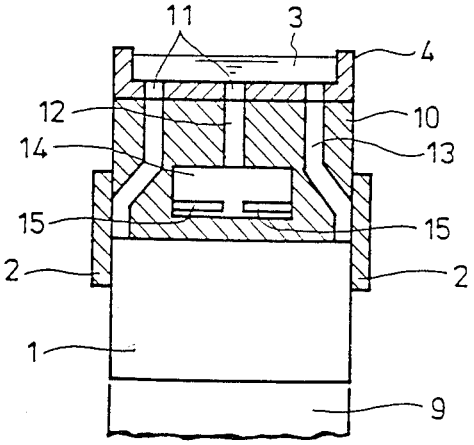
FIG. 4 is a sectional view taken along the line IV—IV of FIG. 3.

Referring now to FIGS. 3 and 4, a first embodiment of the present invention will be described. A pair of cooling rolls 1 are disposed horizontally and substantially in parallel with each other and are spaced apart from each other in the radial direction thereof. Side dams 2 are disposed at the widthwise ends of the cooling rolls 1 so that the pair of cooling rolls 1 and the side dams 2 at the widthwise ends thereof define a basin 7. A tundish 4 for pouring melt 3 is disposed above the cooling rolls 1 and a core 10 extends downwardly from the bottom of the tundish 4 such that the lower end of the core 10 is submerged into the basin 7 and both sides of the core 10 extending in the widthwise direction of the cooling rolls 1 are made into contact with the side dams 2. In the core 10, intermediate and side pouring passages 12 and 13 in communication with respective melt charging holes or downspouts 11 of the tundish 4 are defined in the widthwise direction of the cooling rolls 1. The pouring passages 12 and 13 substantially vertically extend downwardly along a plane in the middle between the axes of the rolls 1, i.e., the plane passing the midpoint of a line interconnecting the axes of the rolls 1 at right angles to the line. A manifold 14 is defined within the core 10 and is communicated with the lower end of the intermediate pouring passage 12 and further with discharge passages 15 of the core 10. The discharge passages 15 in the form of slits extend in the widthwise direction of the cooling rolls 1 and slit nozzles 17 are opened toward a point 16 (higher than a position where the solidified shell 8 is started to be formed) at which the cooling rolls and melt contact with each other under the condition that the core 10 is kept submerged into the basin 7. No manifold is provided for the side pouring passages 13 since melt must flow there under higher pressure or at higher flow rate so as to melt the solidified shell 8 especially grown at the side dams 2 for prevention of the solidified shell 8 from growing at the triple points defined by the cooling rolls 1, the side dams 2 and melt 3 and for prevention of resulting damages along the widthwise sides of the casing 9 during rotation of the cooling rolls 1.

Next the mode of operation will be described. When melt 3 in the tundish 4 is charged through the downspouts 11, it flows through the intermediate pouring passage 12, the manifold 14 and the discharge passages 15 as well as through the side pouring passages 13 so that the basin 7 is defined by the cooling rolls 1 and the side dams 2 disposed at the widthwise ends thereof.

Melt 3 flowing down through the intermediate pouring passage 12 is temporarily stored in the manifold 14 in communication with the lower end of the intermediate pouring passage 12. While the melt 3 is decreased in flow rate it melt 3 flows through the slit nozzles 17 toward the point 16 of contact between the cooling rolls 1 and melt 3. It follows therefore that melt at higher pressure or flow rate is prevented from directly acting on the solidified shell 8 formed by the cooling rolls 1 below the core 10. Furthermore, the direction of flow of melt is toward the point 16 of contact of the cooling roll 1 with melt 3 so that the solidified shell 8 can be prevented from being melted again. As a result, even during supply of melt 3 to the basin 7, the basin 7 can be maintained in the stable state and a high-quality casting 9 uniform in thickness and free from cracks and bulging can be continuously formed.

Figure 5:
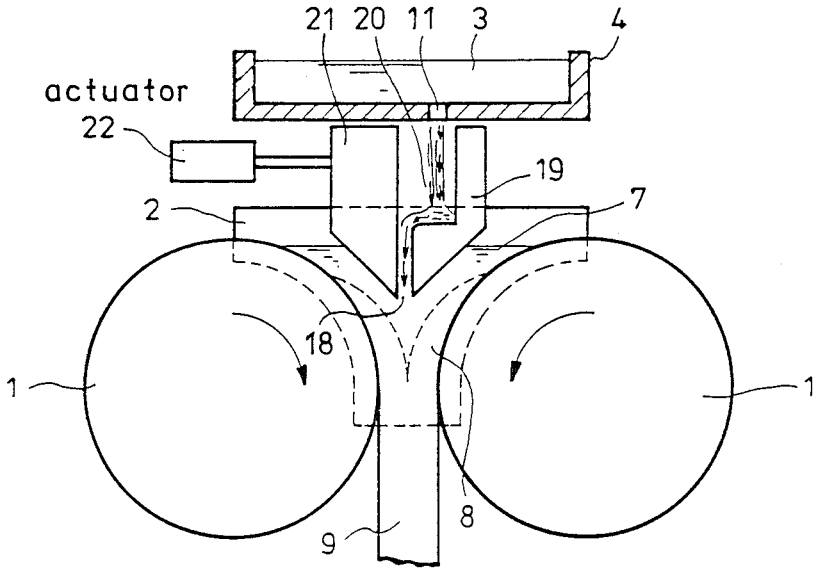
FIG. 5 is a front view of a second preferred embodiment of the present invention.
Figure 6:
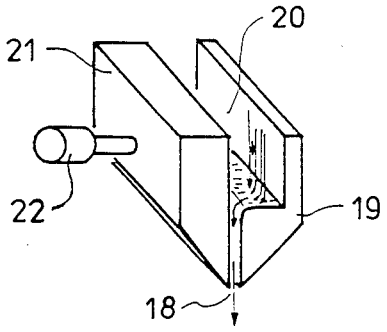
FIG. 6 is a perspective view of a core thereof.

Referring next to FIGS. 5 and 6, a second embodiment of the present invention will be described. A pair of cooling rolls 1 are disposed in parallel with each other in a spaced-apart relationship and side dams 2 are made into contact with both end faces of the cooling rolls 1, whereby a basin 7 for receiving melt 3 therein from a tundish 4 is defined. A core which is supportedly inserted into the basin 7 is vertically divided into two sections 19 and 21 along a plane in the middle between the axes of the cooling rolls. Opposing surfaces of the core sections 19 and 21 define a slit nozzle 18. One 19 of the two core sections is held stationary as a stationary core and is formed with a manifold 20 with a widthwise extending step for decreasing the flow rate of melt 3 flowing down through a downspout 11 extending downwardly from the tundish 4 to charge melt 3 into the basin 7. The manifold 20 is communicated with the slit nozzle 18 and has a widthwise distance larger than that of the latter; that is, the distance between the inner wall above the step of the stationary core section 19 and the opposing inner wall surface of the other core section 21 is selected longer than the distance between the inner opposing surfaces of the core sections 19 and 21 below the step of the core section 19 which together define the slit nozzle 18.

The other core section 21 is so supported as to move toward or away from the stationary core section 19 so as to adjust the distance between the core sections 19 and 21. The movable core section 21 is connected to and is driven by an actuator 22 disposed outwardly of the core section 21.

Melt 3 flowing down through the downspout 11 from the tundish 4 is temporarily received in the manifold 20 which is defined by the step on the stationary core section 19 so that the flow rate of melt 3 is decreased and the impact of melt is reduced. Thereafter melt 3 flows from the manifold 20 into the slit nozzle 18. The actuator 22 is adapted to be energized to move the movable core section 21 toward or away from the stationary core section 19, thereby adjusting the width of the slit nozzle 18 and consequently controlling the flow rate of melt 3 flowing through the nozzle 18.

According to the second embodiment with the abovedescribed construction, the flow rate of melt flowing downwardly is decreased in the manifold and melt 3 is poured uniformly in the widthwise direction through the slit nozzle 18. As a result, any local delay in growth of the solidified shell 8 formed around the outer cylindrical surfaces of the cooling rolls 1 and melting of the existing solidified shell 8 can be prevented.

Furthermore, depending upon casting conditions, the actuator 22 is energized to adjust the width of the slit nozzle 18 in the manner described above to thereby control the quantity of melt to be poured.

Figure 7:
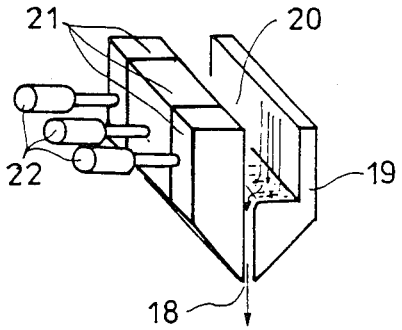
FIGS. 7 and 8 are perspective views of modifications of the core shown in FIG. 6.

FIG. 7 shows a first modification of the core portions described above with reference to FIG. 6. The movable core section 21 is further sectioned along the width of the rolls 1 into three sub-sections which are connected to and driven by three independent actuators 22 independently of each other.

Figure 8:
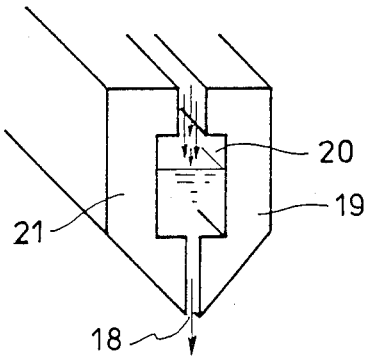

According to the first modification, the width of the slit nozzle 18 may be varied along the width of the rolls 1 to adjust the flow rates of melt especially at widthwise ends (that is, zones adjacent to the side dams), whereby the triple-point problem can be solved. The movable core section 21 has been described as being further sectioned into three sub-sections, but is is apparent that the movable core section 21 may be sectioned into four or more sub-sections. It has been described that the manifold 20 is formed in one of the two core sections 19 and 21; but as shown in FIG. 8, both of the core sections 19 and 21 may be stepped to form a manifold 20 for each of the core sections 19 and 21. Furthermore, a recess or recesses for storing melt therein may be formed on the step. Furthermore, other modifications may be of course effected within the true spirit and scope of the present invention.

As described above, with the pouring device for a dualroll type continuous casting machine in accordance with the present invention, the flow rate of melt charged into the basin can be decreased and then melt is supplied in the form of a slit. Therefore, melt can be poured out slowly and uniformly in the widthwise direction so that the poured melt will not adversely affect the existing solidified shell. As a result, a high-quality casting in the form of sheet can be formed in a stabilized manner; the yield can be increased; and serious troubles can be avoided so that a high degree of productivity of a dual-roll type contious casting machine can be ensured.

What is claimed is:

1. In combination, a pair of cooling rolls and a pouring device for a dual-roll type continuous casting machine wherein a basin is defined by said cooling rolls disposed horizontally and in parallel with each other and side dams disposed at ends of said cooling rolls, a tundish being disposed above said basin, a core extending downwardly from a bottom of said tundish such that a lower end of said core is submerged into said basin, an improvement comprising said core being sectioned into two sections along a vertical plane passing substantially midway between axes of said cooling rolls so that the two core sections define a slit nozzle therebetween, at least one of said core sections being formed with a manifold extending below a downspout of the tundish in an axial direction of said cooling rolls and communicated with said tundish and said slit nozzle for charge of melt in said tundish into said basin, a dimension of said manifold in a direction perpendicular to the axes of the cooling rolls being greater than that of said slit nozzle.

2. The combination according to claim 1, wherein at least one of said core sections is connected to and driven by actuator means for movement toward or away from the other core section.

3. The combination according to claim 2, wherein said at least one core section is further sectioned in the axial direction of the rolls into a plurality of sub-sections each of which is connected to and driven by an actuator to move said subsections independently of each other.

* * * * *